United States Patent [19]

Garneau et al.

[11] Patent Number: 4,742,842

[45] Date of Patent: May 10, 1988

[54] HYDRO-PNEUMATIC PRESSURE VESSELS

[75] Inventors: Claude J. E. Garneau, Ste. Thérèse, Canada; Walter C. Stethem, San Leandro, Calif.

[73] Assignee: Hamlet & Garneau Inc., Laval, Canada

[21] Appl. No.: 936,595

[22] Filed: Dec. 1, 1986

Related U.S. Application Data

[63] Continuation-in-part of Ser. No. 825,666, Feb. 3, 1986, abandoned.

[51] Int. Cl.[4] ..... F16K 31/22

[52] U.S. Cl. ..... 137/172; 137/192; 137/207

[58] Field of Search ..... 137/172, 192, 190, 399, 137/207

[56] References Cited

U.S. PATENT DOCUMENTS

| | | | |
|---|---|---|---|
| 1,750,489 | 3/1930 | Pippin | 137/399 |
| 1,938,956 | 12/1933 | Fee . | |
| 2,487,073 | 11/1949 | Schroeder . | |
| 2,561,528 | 7/1951 | Meyers . | |
| 2,594,105 | 4/1952 | Watts . | |
| 3,301,275 | 1/1967 | Brady . | |
| 3,938,335 | 2/1976 | Marwick . | |
| 4,458,714 | 7/1984 | Delwiche | 137/172 |

FOREIGN PATENT DOCUMENTS

| | | | |
|---|---|---|---|
| 6366 | of 1893 | United Kingdom | 137/192 |
| 29548 | of 1904 | United Kingdom | 137/192 |
| 8171 | of 1904 | United Kingdom | 137/192 |

*Primary Examiner*—Alan Cohan

*Attorney, Agent, or Firm*—Samuel Meerkreebs

[57] ABSTRACT

A hydro-pneumatic expansion tank is provided in a water pipe circuit. The hydro-pneumatic pressure vessel is in the form of a water/air expansion tank communicating with the pipe circuit by means of a conduit and a float valve is provided in the conduit. The expansion tank includes air under pressure and the water. A barrier liquid is provided as a barrier layer between the water and the air, the barrier liquid being made of a clear polyalphaolefin fluid which is impermeable to water and does not readily absorb oxygen. The float valve has a float member having a specific gravity less than the specific gravity of water but greater than the specific gravity of the barrier liquid such that when the barrier liquid is being drained from the expansion tank, the float member in the valve will sink onto the valve seat when the barrier liquid is in the valve chamber thus closing the valve.

3 Claims, 4 Drawing Sheets

HYDRO-PNEUMATIC PRESSURE VESSELS

CROSS-REFERENCE TO RELATED APPLICATION

This application is a continuation-in-part application of application Ser. No. 825,666, filed Feb. 3, 1986, now abandoned.

BACKGROUND OF THE INVENTION

1. Field of the invention

The present invention relates to hydro-pneumatic pressure vessels, and more particularly to a device for maintaining the gas separate from the liquid in the system.

2. Description of the Prior Art

In a typical closed water heating or cooling system, it is customary to maintain the water under pressure and to provide for the expansion of the water by including an expansion tank in the system whereby air under pressure is utilized to maintain the water under pressure and to act as a buffer for the expanding water in the closed system. Since the air in the expansion tank tends to dissolve, especially as the temperature and pressure rises, it has been suggested to provide a diaphragm in the expansion tank as described by C. H. Kirk in an article entitled "How to Control Air in Hydronic Systems", published in The Journal of Plumbing, Heating and Air Conditioning in the early 1960s. The diaphragm will prevent the air from being absorbed in the water by keeping the air separate from the water. Such diaphragms, however, are subject to deterioration due to continuous flexing and aging of the diaphragm, and eventually become the weak point in the system.

SUMMARY OF THE INVENTION

It is an aim of the present invention to provide an improved air/liquid separation arrangement for use in a hydropneumatic system.

It is a further aim of the present invention to provide an improved valve adapted to operate in a system where two liquids having different specific gravities are present.

A construction in accordance with the present invention comprises a liquid/gas expansion vessel. A conduit communicates the expansion vessel with a liquid in a pipe circuit. A gas under pressure occupies a first portion of said vessel, and the liquid occupies another portion of said vessel. An impermeable barrier liquid having a specific gravity which is less than the specific gravity of the liquid is present between the liquid and the gas. The barrier liquid is selected such that it does not readily absorb the gas and thus provides a fluid barrier membrane between the liquid and the gas in the vessel.

More specifically, the invention also includes a valve means in the conduit, the valve means being responsive to the presence of barrier liquid in the valve to shut off the conduit to prevent the barrier liquid from entering the pipe circuit.

A valve means in accordance with another aspect of the present invention includes a valve body, a valve chamber defined in the body, and a valve seat in the bottom of the chamber. An outlet communicates with the chamber through the valve seat and an inlet communicates with the chamber and with the portion of the conduit leading to the expansion vessel. A floating valve member is adapted to close the valve when on the valve seat. The specific gravity of the valve member is such that it floats in said liquid, thus keeping the valve open and submerges in the barrier liquid, when barrier liquid is present in the valve chamber, to be seated on the valve seat to thus close the valve.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
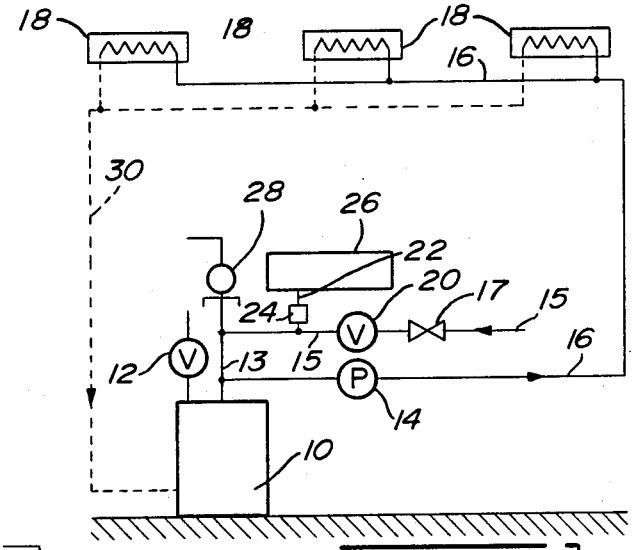
FIG. 1 is a schematic diagram of a typical closed water circulation system utilizing the present invention.

Referring now to the drawings and particularly to FIG. 1, there is shown a typical hot water heating system in a building utilizing a furnace boiler 10 having a relief valve 12 and a manifold pipe 13. A feed line 15 from a city main is connected through a manual shut-off valve 17 through an automatic pressure sensitive feed valve 20 which is connected eventually to the manifold pipe 13. A closed circuit line includes pipes 16 connected to terminal heat transfer units 18. The water is circulated through pipes 16 by means of a circulating pump 14.

Other conventional elements of the closed circuit heating system include an air vent 28 at the end of the pipe 13 and a return pipe 30 returning the cooled water to the furnace 10. An expansion tank 26 is connected to the pipe of the feed line 15 through a conduit 22 which passes through a float valve 24 which will be described in more detail later.

Figure 2:
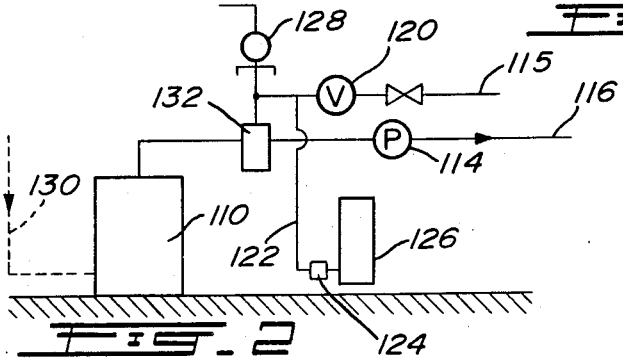
FIG. 2 is a fragmentary schematic diagram showing a variant of the circuit shown in FIG. 1, but utilizing the present invention.

A modification of the circuit shown in FIG. 1 is illustrated in FIG. 2 where like elements have been identified by numerals raised by 100.

In the embodiment shown in FIG. 2, the expansion tank 126 is a standup device mounted on the floor, while the float valve 124 is arranged in the conduit 122 and is connected to the feed line pipe 115. In this case, an air separator 132 is also provided on line 116 directed to the air vent 128.

Figure 3:
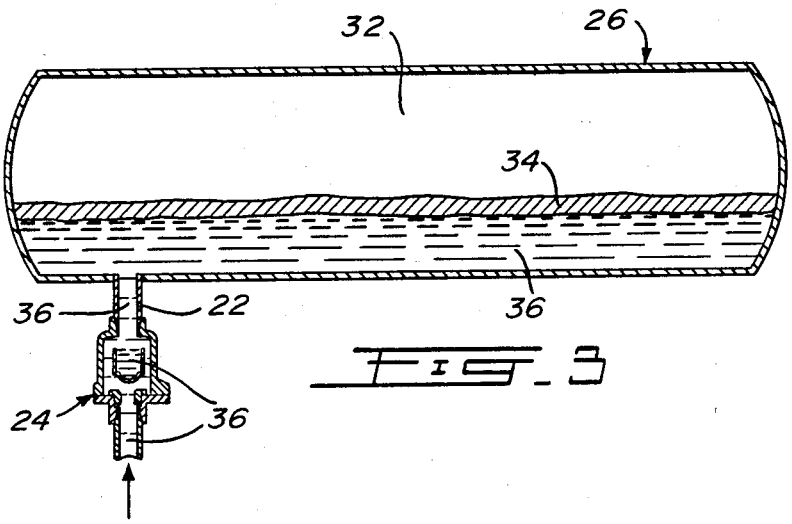
FIG. 3 is a vertical cross-section taken through a detail of the present invention.
Figure 4:
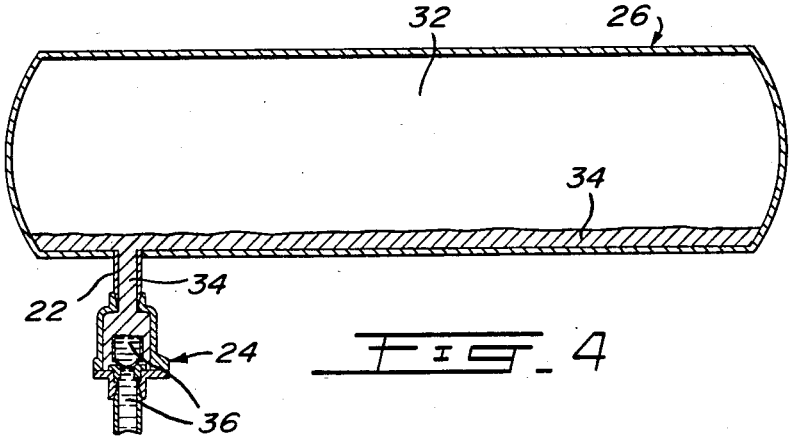
FIG. 4 is a vertical cross-section similar to FIG. 3 showing the elements in a different operative position.

The expansion tank 26 is provided with air 32 under pressure, and the conduit 22 allows water in the circuit to enter the expansion tank 26 as the water is expanded due to increased temperature and/or pressure. The air in the expansion tank 26 acts as a buffer or cushion for the expanding water. As shown in FIGS. 3 and 4, a barrier liquid 34 is provided on the surface of the water 36 at the interface between the water 36 and the air 32 under pressure.

The liquid barrier 34 must be a material which is impermeable and will not absorb air and have a specific gravity less than that of water in order to float on water.

The barrier liquid must prevent the transfer of oxygen to the water. It should also be stable under a wide range of temperatures, and it should not be water soluble. In potable water systems, the barrier liquid should not be toxic and should be biologically stable. An example of such a barrier liquid is polyalphaolefin oil sold under the trade mark Mobil SHC 629 Fluid (is a registered trade mark of Mobil Oil Corporation). This liquid is a clear synthesized hydrocarbon fluid. The barrier liquid replaces a rubber or other elastomeric diaphragm currently used in similar expansion tanks.

In order to prevent the draining of the polyalphaolefin oil 34 into the water system, in the event of a substantial retraction of the water, a float valve 24 is provided in the conduit 22 immediately adjacent to the expansion tank 26. FIGS. 5 through 8 show various embodiments of the float valve. In the embodiment illustrated in FIG. 5, there is provided a valve housing 38 closed off by a bottom plate 44 which in this case is fastened to the housing 38 by means of bolts 48. The housing 38 and plate 44 define a valve chamber 42. A socket 40 at the top of the housing 38 allows a threaded connection to a portion of the conduit 22 for communication with the valve chamber 42. Similarly, the other portion of the conduit 22 is mechanically threaded to socket 46 on the plate 44, allowing communication with the valve chamber 42.

Within the valve chamber 42 is a valve seat 50 threaded to the plate 44 and fixed at the bottom of the chamber. The valve seat 50 is provided with an O-ring 52, while a bore 54 is defined in the valve seat 50 within the confines of the O-ring 52. The bore 54 communicates with the pipe 22.

Figure 5:
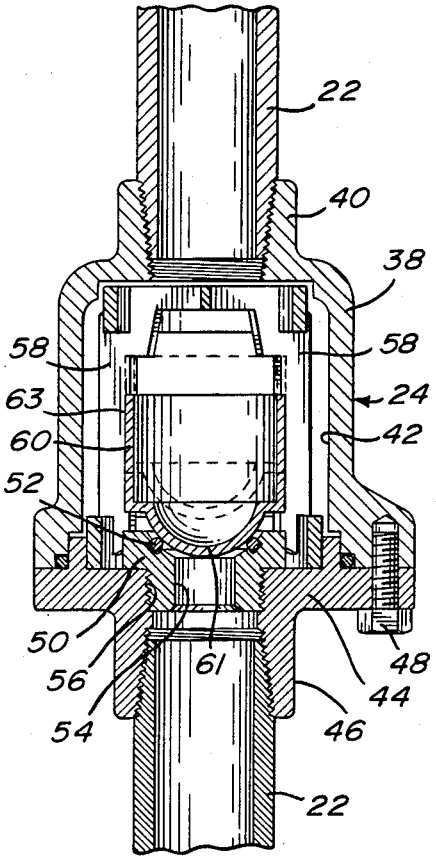
FIG. 5 is a vertical cross-section of a detail of the present invention.

A guide cage 58 is located within the chamber 42 and is adapted to guide the floating valve plug 60 which, in the embodiment of FIG. 5, is in the form of an open cup. The plug 60 is provided with a bottom semi-spherical portion 61, while the upstanding portion of the valve plug 60 is in the form of a circular cylinder defined by the walls 63. The material of the valve plug 60 is such that it is buoyant in water. As long as water is within the valve chamber 42, the valve plug 60 will be in its open position as illustrated in dotted lines in FIG. 5.

Figure 6:
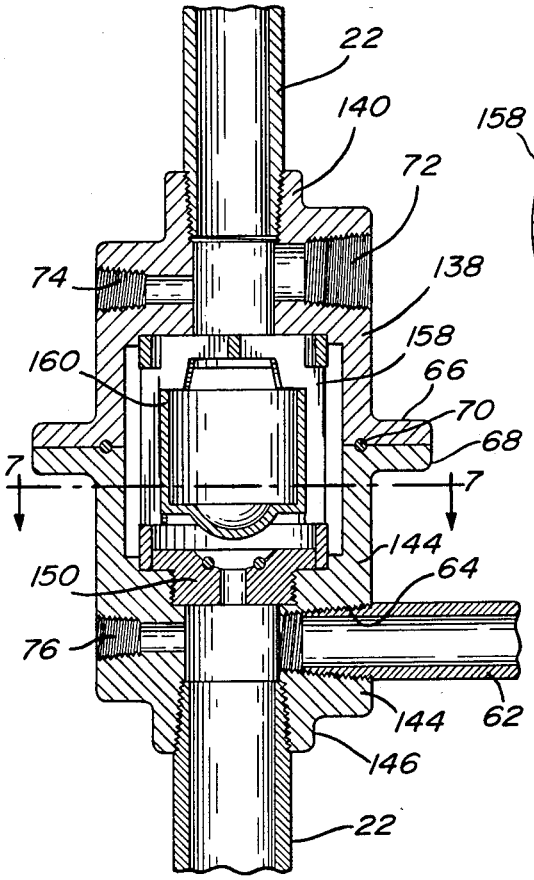
FIG. 6 is a vertical cross-section of another embodiment of the detail shown in FIG. 5.
Figure 7:
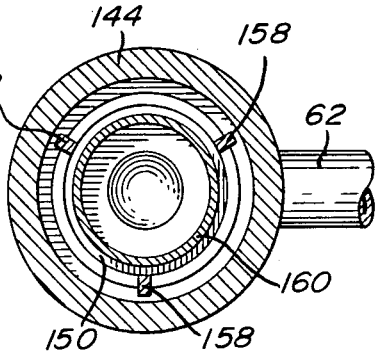
FIG. 7 is a horizontal cross-section taken through line 7—7 of FIG. 6.

The open position is also illustrated in the embodiment shown in FIG. 6. Thus, the valve plug 60 and the valve 24 therefore will normally be in its open position and water will continually circulate back and forth as it is entering or retracting from the expansion tank 26 through the valve chamber 42. The plug 60, being open at its top, will, of course, be filled with water. Yet, since the material of the walls 63 and the bottom 61 have specific gravity less than water, the plug 60 will be found to float at the top of the valve chamber 42 against the guide cage 58.

If, for some reason, the water retracts completely from the expansion tank 26, the barrier liquid 34 will start to drain from the expansion tank 26. The barrier liquid, when entering the valve chamber 42, will cause the plug 60 to be submerged in the liquid 34 until the spherical bottom 61 is received completely on the O-ring 52 of the valve seat 50. This, in effect, closes the valve and prevents any further barrier liquid 34 from being drained through the valve 24. The reason the plug 60 is caused to sink or be submerged in the liquid 34 as it enters the valve chamber 42 is the weight of the water within the cup 60 which, of course, has a higher specific gravity than the barrier liquid 34, and whether or not the walls of the plug 60 are buoyant in the barrier liquid, the plug 60 will sink and close the valve because of the weight of the water. It would be preferable, however, to choose the material of the plug 60 such that it is buoyant in water but would submerge in the barrier liquid. Thus, the specific gravity of the walls of the plug 60 should be higher than the specific gravity of the barrier liquid.

The embodiment illustrated in FIG. 6 is very similar to the embodiment of FIG. 5 with the exception that the housing is larger and access ports are provided in this housing. The bottom wall 44 now becomes a symmetrical housing element 144, that is, symmetrical to the housing element 138. All of the other elements which are identical to the elements shown in FIG. 5 will not be described in detail but have been shown in the drawings and identified by numerals which have been raised by 100. In the housing portion 138, an access port or socket 72 is provided for the purpose of feeding when necessary the barrier liquid to the tank 26. The port 74 can accept a pressure gauge and charge valve for the expansion tank 26. Port or socket 64 can accept, for instance, a pipe 62 from the water feed 15. Finally, the port 76 could receive a pressure gauge to measure the pressure in the pipe circuit.

Figure 8:
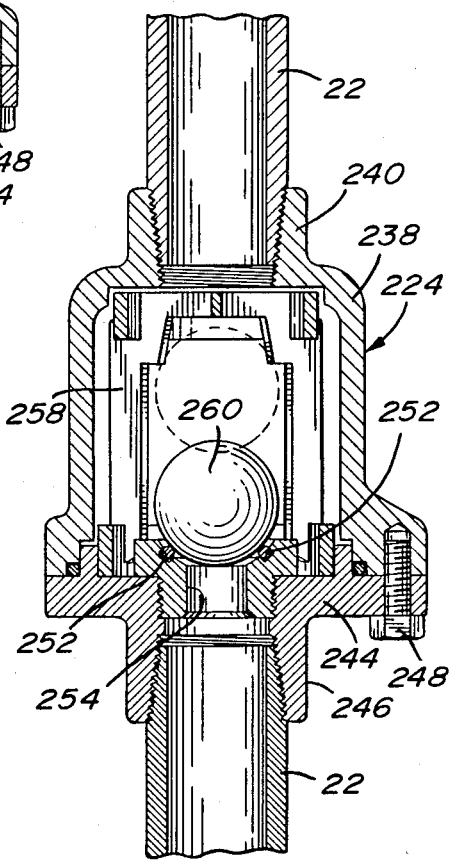
FIG. 8 is a vertical cross-section taken through yet another embodiment of the detail shown in FIG. 5.

The valve 24 illustrated in FIG. 8 is identical to the valve shown in FIG. 5 and the identical elements have been identified by numerals which have been raised by 200. These elements will not be repeated in this disclosure. Instead of an open cup-shaped plug 60, the float plug 260 is in the form of a sphere. In the case of the spherical plug 260, it is important that it be made of a material which is of a greater specific gravity than the barrier liquid 34 but of a lesser specific gravity than the water 36 of the system.

In operation, and having reference to the valves shown in FIGS. 5 through 8 and the expansion tank shown in FIGS. 3 and 4, the water in the conduit 22 would normally take up a portion of the expansion tank 26, and most of the variations in the expansion of the water would be provided for within the tank 26. Thus, as the water expands in the tank 26, the barrier liquid 34, which floats on the water 36, moves up to compress the air 32. When the water retracts back into the pipe circuit because of cooling or lower pressure caused by leakage, etc., the air 32 will force the barrier liquid 34 and the water 36 to the lower part of the expansion tank. In the case where the water is completely drained from the expansion tank as shown in FIG. 4, the barrier liquid will, of course, drain into the conduit 22 through the valve 24. As long as water is circulated in conduit 22, the valve 60, 160 or 260, is floated towards the upper portion of the guide cage 58, 158 and 258. Immediately, barrier liquid enters the chamber 42, 142 and 242, the plug 60, 160 and 260 will sink onto the valve seat 50, 150 and 250 to close off the valve, and therefore prevent any further barrier liquid from leaking to the hot water pipe system.

Figure 10:
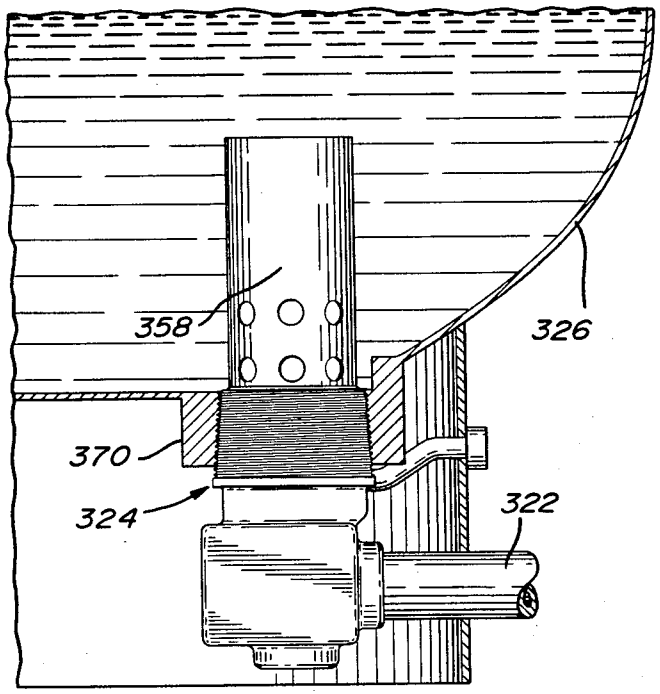
FIG. 10 is an enlarged vertical elevation of the valve shown in FIG. 9 arranged in the environment of an expansion tank.
Figure 9:
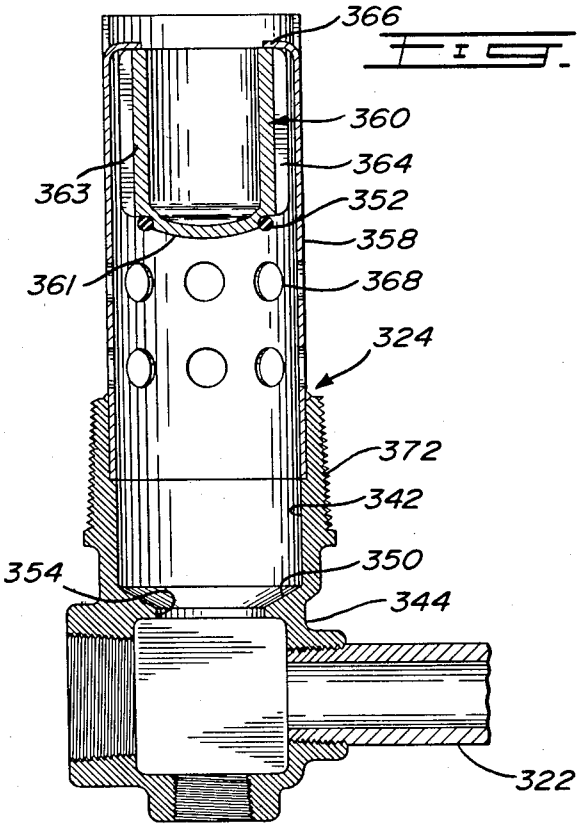
FIG. 9 is a vertical cross-section of another embodiment of the float valve shown in FIG. 5.

Another embodiment of the valve is illustrated in FIGS. 9 and 10. In this embodiment, the valve is identified by the numeral 324. The valve 324 is meant to sit within the tank 326, preferably at the base thereof.

As shown in FIG. 9, the valve has a valve base 344 defining a valve seat 350 which in turn surrounds an opening 354 in the bottom of the base 344. A cylindrical cage 358 sits in the base 344. The cylindrical cage 358 is provided with large apertures 368, as shown in the drawing. The top of the cage 358 is open, and there are short indentations 366 provided to act as a stop for the plug 360.

The plug 360 is defined as a hollow cup having a dome-shaped base 361 and a cylindrical wall 363. Guide fins 364 are provided on the wall 363 to prevent the plug 360 from moving freely from side to side within the cage 358. The bottom 361 is provided with the O-ring 352. The plug 360 operates in the same manner as described in the previous embodiments of FIGS. 5 and 6. The difference in this embodiment is that the O-ring 352 is provided on the plug 360 rather than on the valve seat 350. Likewise, the cage 358 is exposed to the interior of the tank and, therefore, the liquid in the tank surrounds the cage 358 and enters the valve chamber 342. The plug 360 is full of the liquid, such as water, and, therefore, will descend as the water is drained from the tank 326. The valve will, of course, be blocked off when the plug 360 sits on the valve seat 350.

We claim:

1. A float valve for use in a pipe circuit in which at least two fluids are present, at least one fluid being a liquid, said liquid having a specific gravity greater than said other fluid, the valve comprising a valve body, a valve chamber defined in said body, a valve seat in the bottom of said chamber, an outlet communicating with said chamber through the valve seat and with a pipe circuit, and inlet communicating with the chamber, a float valve member adapted to close the valve when seated on the valve seat, the specific gravity of the valve member being less than the specific gravity of said liquid, the float valve member being in the form of an upwardly opening cup having a bottom portion adapted to sealingly engage said valve seat and prevent fluid from flowing thereby, the open-ended cup allowing liquid to be present therein during operation of the valve such that the valve member will have a specific gravity less than and close to the specific gravity of the first liquid, such that the float member will float in the valve chamber in the presence of said first liquid keeping the valve open and will submerge in the presence of the other fluid to close said valve, the chamber comprising an upright tubular cylindrical member open at its upper end, means within said chamber and engaged between said valve member and the interior of said tubular cylindrical member for guiding said valve member in reciprocating movement toward and away from said valve seat, stop means adjacent the top of said cylindrical member for retraining said float valve member therein, the tubular cylindrical member forming said valve chamber being intermediately perforated to allow fluid to readily pass in and out thereof so that the floatable valve member has substantially instantaneous response to the different specific gravities of the respective liquids.

2. A float valve as defined in claim 1, wherein the cup-shaped float valve member includes an O-ring sealing member at the bottom thereof to sealingly engage the valve seat.

3. A float valve as defined by claim 1 in which said valve member includes integral fins comprising said means for guiding said floatable valve member in its reciprocation within said valve chamber, said stop means comprising inwardly projecting portions of said cylinderical member disposed inwardly beyond said integral fins.

* * * * *